US005522523A

United States Patent [19]

Nogles

[11] Patent Number: 5,522,523

[45] Date of Patent: Jun. 4, 1996

[54] WATER HEATER HAVING FLEXIBLE LINER AND METHOD FOR MAKING THE SAME

[75] Inventor: Thomas G. Nogles, Broomall, Pa.

[73] Assignee: Southcorp Water Heaters USA, Inc., Bala Cynwyd, Pa.

[21] Appl. No.: 469,805

[22] Filed: Jun. 6, 1995

Related U.S. Application Data

[63] Continuation of Ser. No. 195,386, Feb. 14, 1994, abandoned.

[51] Int. Cl.[6] ..... F22B 5/02

[52] U.S. Cl. ..... 220/404; 392/451; 392/455

[58] Field of Search ..... 220/403, 404, 220/678; 383/113; 229/3.5 MF; 392/444–446, 449–450, 458–460; 219/438–440

[56] References Cited

U.S. PATENT DOCUMENTS

| | | | |
|---|---|---|---|
| 996,350 | 6/1911 | Lamb | 392/453 |
| 2,175,307 | 10/1939 | Peck | 392/460 |
| 2,266,250 | 12/1941 | Osterheld | 392/459 |
| 2,273,505 | 2/1942 | Florian . | |
| 2,375,380 | 5/1945 | Osterheld | 392/459 |
| 2,415,966 | 2/1947 | Osterheld | 392/459 |
| 2,695,753 | 11/1954 | Kirk, Jr. . | |
| 3,366,263 | 1/1968 | Murdock | 220/678 |
| 3,434,660 | 3/1969 | Brumme et al. . | |
| 3,502,843 | 3/1970 | Stryer | 392/454 |
| 3,601,128 | 8/1971 | Hakim . | |
| 3,621,882 | 11/1971 | Kuplec . | |
| 3,675,684 | 7/1972 | Mercier et al. . | |
| 3,721,371 | 3/1973 | Dolveck . | |
| 3,722,751 | 3/1973 | Bisciglia . | |
| 3,828,608 | 8/1974 | Yamamoto . | |
| 3,902,624 | 9/1975 | Stephenson . | |
| 3,917,115 | 11/1975 | Travers et al. . | |
| 4,013,221 | 3/1977 | Eder . | |
| 4,206,908 | 6/1980 | Mercier . | |
| 4,211,208 | 7/1980 | Lindner . | |
| 4,296,799 | 10/1981 | Steele | 220/444 |
| 4,340,379 | 7/1982 | Williamson . | |
| 4,635,814 | 1/1987 | Jones | 220/403 |
| 4,658,434 | 4/1987 | Murray . | |
| 4,777,346 | 10/1988 | Swanton, Jr. | 392/447 |
| 4,981,112 | 1/1991 | Adams et al. . | |
| 5,005,726 | 4/1991 | Robbins | 220/404 |
| 5,009,647 | 4/1991 | Cross et al. | 383/113 |
| 5,071,710 | 12/1991 | Smits et al. | 383/113 |
| 5,110,643 | 5/1992 | Akao et al. . | |
| 5,168,546 | 12/1992 | Laperriere et al. | 392/459 |
| 5,169,019 | 12/1992 | Budenbender | 220/404 |
| 5,183,086 | 2/1993 | Fanta et al. | 220/404 |
| 5,207,250 | 5/1993 | Tsao . | |
| 5,253,778 | 10/1993 | Sirosh . | |
| 5,348,623 | 9/1994 | Salmon | 392/456 |

FOREIGN PATENT DOCUMENTS

| | | | |
|---|---|---|---|
| 2219773 | 9/1990 | Japan | 383/113 |

*Primary Examiner*—Stephen J. Castellano
*Attorney, Agent, or Firm*—Miller & Christenbury

[57] ABSTRACT

A lined water heater storage tank having a welded metallic shell and a bag-like liner within the shell. The welded metallic shell has ports for flow of water into and out of the storage tank, and the liner has fittings corresponding to the ports on the shell for the flow of water into and out of the liner. The fittings on the liner are mounted on the ports on the metallic shell. The bag-like liner prevents contact between water within the liner and the inner surface of the shell.

7 Claims, 5 Drawing Sheets

WATER HEATER HAVING FLEXIBLE LINER AND METHOD FOR MAKING THE SAME

This application is a continuation of application Ser. No. 08/195,386, filed Feb. 14, 1994, now abandoned.

BACKGROUND OF THE INVENTION

This invention relates to a water heater provided with a water storage tank having an outer, rigid shell and an inner, flexible liner. It also relates to a method for producing the lined storage tank.

FIELD OF THE INVENTION

Various forms of lined liquid storage tanks have been developed over the years. However, water heater manufacturers have struggled to find an optimal manner of inexpensively and reliably lining water heater storage tanks to prevent corrosion.

It is well known to apply an enamel lining to interior surfaces of a metal storage tank for a water heater. The enameling process, however, is a high-temperature process that exceeds the metal's annealing temperature. But in annealing metal shells the metal stiffness is reduced, thereby requiring the use of thick-walled shells to withstand hydrostatic tests. Also, it is known that enamel linings tend to crack at weld joints and at sharp changes in the contour of a shell's inner surface.

Attempts have also been made to line metallic water heater storage tanks with plastic adhered to the inner walls. Such a lining is disclosed by Lindahl in U.S. Pat. No. 5,217,140. Plastic-lined storage tanks, however, have proven to be expensive to manufacture. The fusing grade resin required for proper adherence between the plastic lining and the shell wall is expensive, and many non-fusing grade resins do not properly adhere. Also, the equipment and process used to adhere plastic to the tank walls are expensive.

Accordingly, there is a great and thus far unsatisfied demand for a lined water heater storage tank having an inexpensive liner to prevent tank corrosion.

OBJECTS OF THE INVENTION

It is an object of this invention to provide a lined storage tank which overcomes the problems associated with prior art designs.

It is another object of the invention to provide a metallic water heater storage tank having a liner that forms a barrier between liquid within the tank and the metallic walls of the tank to prevent corrosion of the tank.

It is a further object of the invention to provide a storage tank liner that serves the functions referred to above and also acts as a vapor barrier.

It is yet another object of this invention to provide a storage tank liner which distributes pressure evenly over the entire inner surface of the storage tank metallic walls.

Another object of the invention is to provide an inexpensive and reliable lined water heater storage tank.

It is still another object of the invention to provide a method for producing a lined storage tank for a metallic water heater tank.

SUMMARY OF THE INVENTION

This invention provides a lined water heater storage tank having a rigid outer shell enclosing a flexible bag-type liner. The liner is mounted to ports in the shell's wall via fittings applied to the liner. The liner provides a liquid and vapor barrier to prevent corrosion of the outer shell without requiring adhesion between the liner and inner surface of the shell. The liner is adaptable for use in lined water heater storage tanks.

This invention also provides a method for making a lined water heater storage tank wherein a flexible bag-type liner is formed and the necessary water heater fittings are applied to the liner's outer surface. The liner is then mounted within the shell before the shell is fully assembled, and the liner fittings are mounted to the ports in the shell wall. The shell is then completed around the liner, and the liner's position within the shell is adjusted by use of air pressure.

Figure 1:
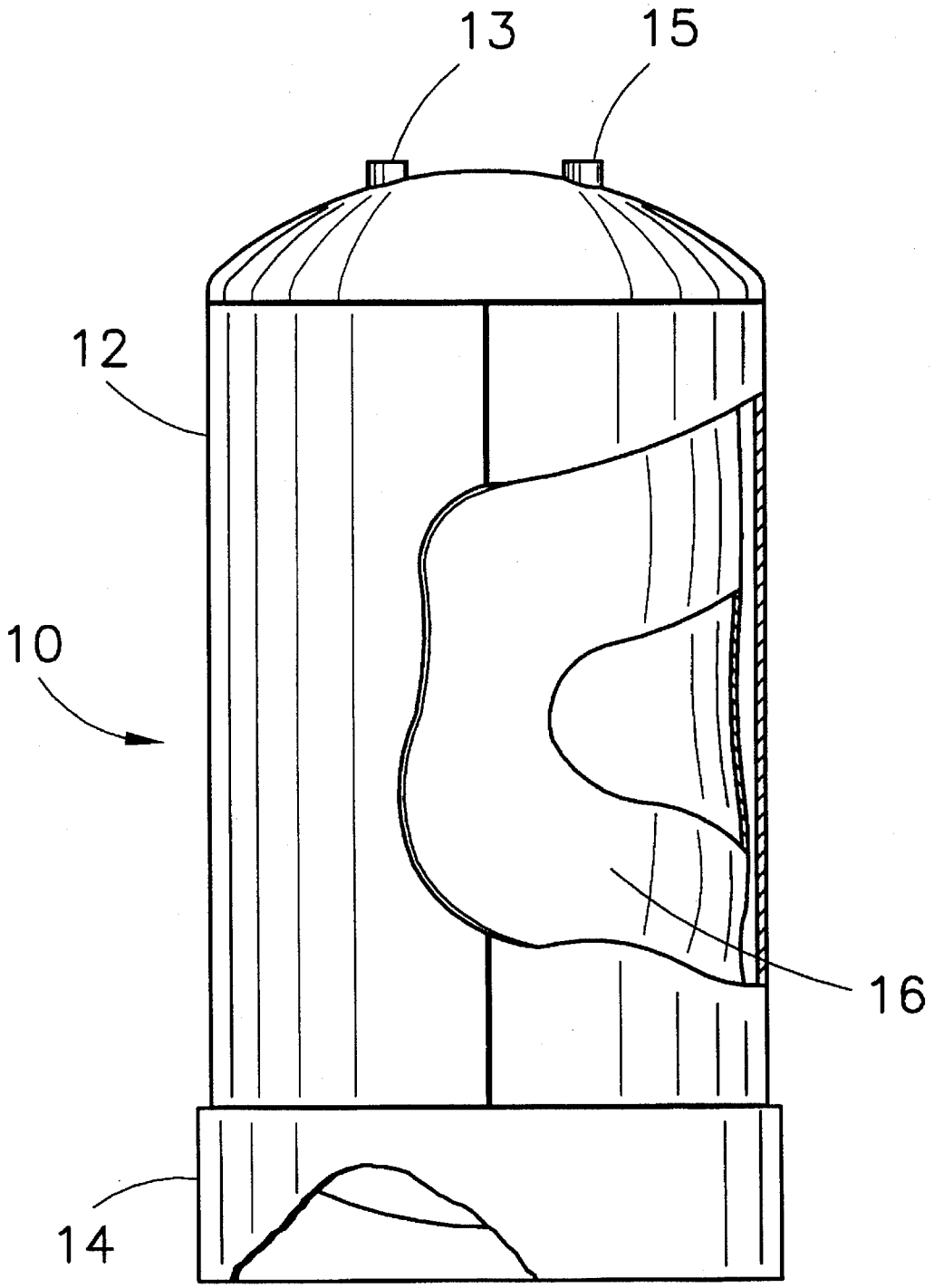
FIG. 1 is a side view, with a portion broken away and shown in section in order to reveal important details, of one form of water heater storage tank embodying features of this invention.

FIG. *6a* is a side view of an electric water heater embodying features of this invention.

FIG. *6b* is a side view of a gas-fired water heater embodying features of this invention.

DETAILED DESCRIPTION OF THE INVENTION

The following description is intended to refer to the specific embodiments of the invention illustrated in the drawings. This description is not intended to define or limit the scope of the invention, which is defined separately in the claims that follow.

Referring to FIG. 1, the numeral 10 designates a water heater storage tank which has an outer shell 12 with ports 13 and 15 for water inlet and outlet, respectively. Storage tank 10 has a base 14 upon which outer shell 12 is mounted. Storage tank 10 has a liner 16 positioned within outer shell 12 for storing water introduced through and removed from ports 13 and 15.

Figure 2:
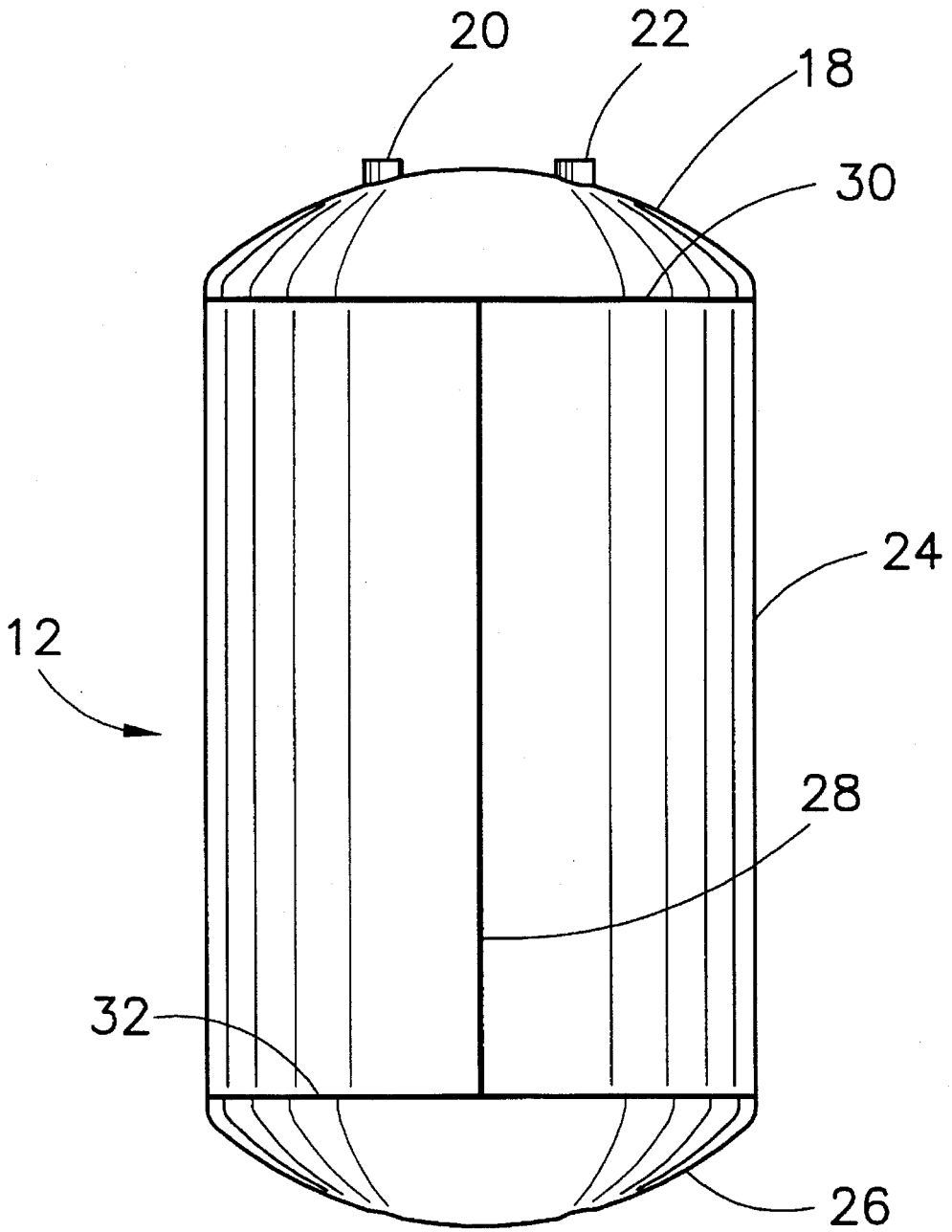
FIG. 2 is a side view of an outer shell component of a storage tank as shown in FIG. 1.

FIG. 2 shows details of outer shell 12 which has an upper cap 18 to which inlet fitting 20 and outlet fitting 22 are attached. Outer shell 12 has a cylindrical wall 24 as well as a bottom cap 26.

Outer shell 12 preferably has a welded construction wherein fittings 20 and 22 are welded to upper cap 18. Cylindrical wall 24 is provided with a weld seam 28. Upper cap 18 is welded to the top of cylindrical wall 24 along weld seam 30, and bottom cap 26 is welded to the bottom of cylindrical wall 24 at weld seam 32.

Outer shell 12 is formed from thin-wall metallic sheet. Preferably, the sheet is of steel and has a thickness of about 0.050 inches. Upper cap 18 and bottom cap 26 are pressed disks, and cylindrical wall 24 is formed from sheet curved about a longitudinal axis and welded at weld seam 28.

Weld seams 28, 30 and 32 are preferably formed by a laser welding process to avoid excessive heat generation. Such laser welding processes are known, of themselves, in the art. The metal sheet is preferably not heated beyond its yield point of about 800° F. so that it is not annealed at or near the weld heat affected zone.

Outer shell 12 may optionally have a two-piece construction whereby two capsule-type portions are deep drawn and welded at a single circumferential weld seam. Similarly, water inlet and outlet ports may be optionally located in the cylindrical wall 34, the bottom cap 26, or in any combination of the shell components illustrated in FIG. 2.

It is important to note that an outer shell for a storage tank embodying this invention need not have a welded construction. For example, shell components are optionally provided with radial flanges that are bolted together, or the shell components can be mechanically fastened in any other known manner. Also, for storage tanks not intended to hold pressure, the outer shell need not have pressure-tight seams so long as the shell provides structural containment for the bag-like liner. Water heater storage tanks are, of course, required to hold water under pressure.

Figure 3:
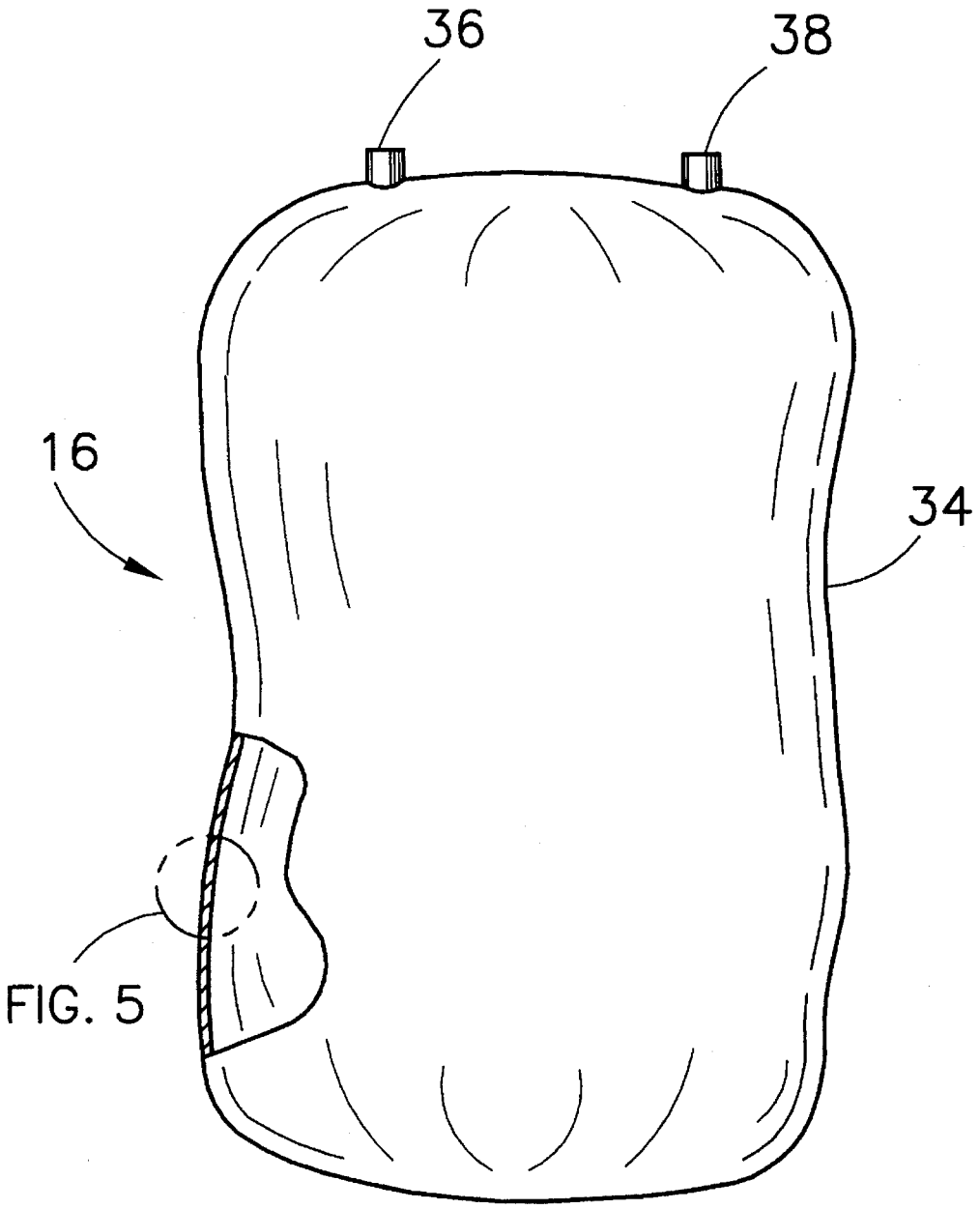
FIG. 3 is a side view of a liner component for a storage tank of the kind shown in FIG. 1.

FIG. 3 shows details of one form of liner 16 selected for illustration in the drawings. Liner 16 is an enclosed bag having a wall 34 upon which fittings 36 and 38 are attached. Fitting 36 is provided for water inlet and fitting 38 for water outlet. Fittings 36 and 38 are attached at holes in wall 34, and are connected via a molding process, a plastics welding process, or any other known process. Wall 34 is preferably flexible and is optionally collapsible in response to pressure differentials between the liner interior and exterior. For example, wall 34 is optionally provided with circumferential pleats (not shown) to permit accordion-like contraction and expansion of liner 16.

Liner 16 is preferably formed by known extrusion processes or optionally by known blow-molding or injection-molding processes. However formed, liner 16 preferably has a bag-like shape having openings only where fittings 36 and 38 and any other needed fittings are mounted. Wall 34 of liner 16 preferably has a multi-layered construction described later in detail with reference to FIG. 5.

Figure 4:
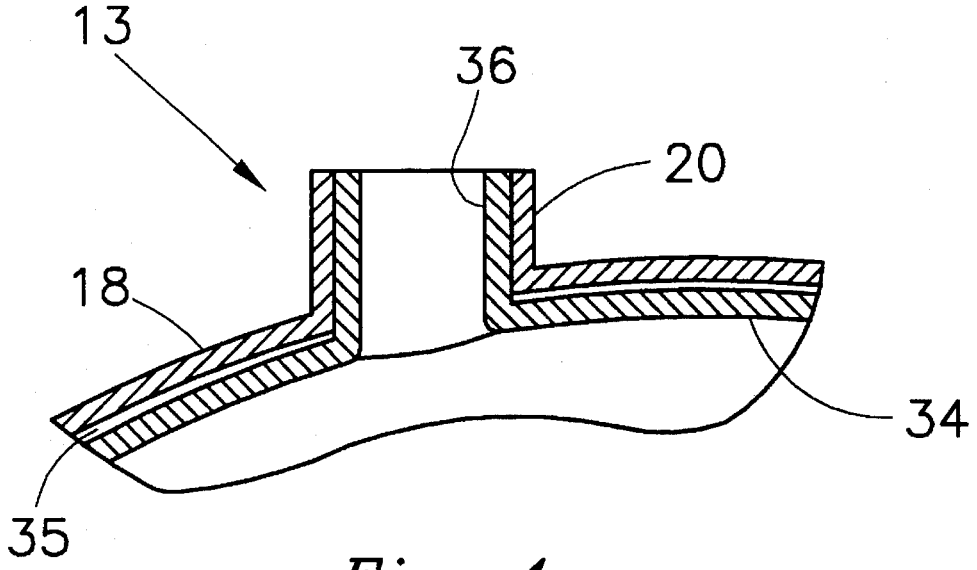
FIG. 4 is a cross-sectional side view of a port on the water heater tank shown in FIG. 1.

FIG. 4 shows details of water inlet port 13 located in upper cap 18 of outer shell 12. Fitting 36 in wall 34 of liner 16 is located within fitting 20 in upper cap 18. Water is introduced through inlet port 13 and fittings 20 and 36 and enters the interior of liner 16. The water does not, however, travel into a region 35 that may exist between wall 34 of liner 16 and outer shell 12.

Fitting 36 in wall 34 of liner 16 is optionally provided with female pipe threads (not shown) for engagement with pipe fittings. However structured, water is prevented from migrating between fittings 20 and 36 and into region 35. The ports should also provide dielectric isolation between the pipe fittings mounted at the ports and the outer shell of the storage tank, thereby preventing the exposure of stored water to dissimilar metals and the accelerated corrosion caused thereby.

Figure 5:
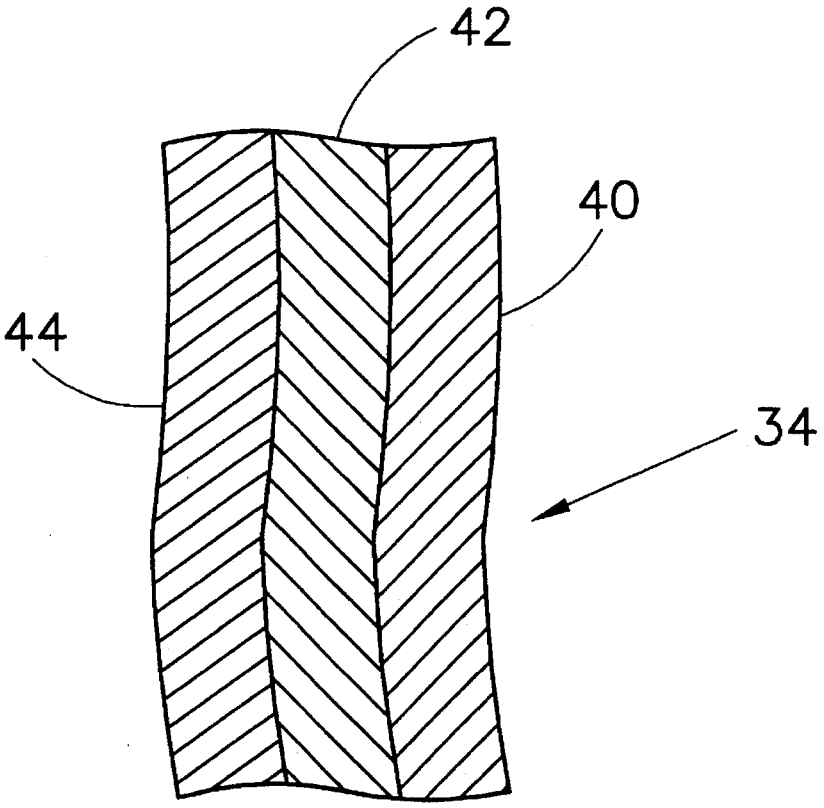
FIG. 5 is a cross-sectional side view of a portion of the liner shown in FIG. 3.

FIG. 5 shows details of a cross section of wall 34 of liner 16. Wall 34 preferably has three or more layers, the embodiment shown in FIG. 5 having three such layers 40, 42, and 44. Layer 40, which faces the interior of liner 16, is formed of a material appropriate for contact with potable water, for example. The material of layer 40 is optionally capable of providing chemical resistance if the storage tank is used for containment of materials other than water. Layer 40 of liner 16 adapted to store water is preferably formed from polyethylene or polypropylene. Layer 42 provides a vapor barrier to retain vapors within storage tank 10. Layer 42 is preferably formed from a metallic layer such as aluminum. Layer 44, the outside layer, is preferably composed of an insulating material for providing a barrier between layer 42 and the interior of outer shell 12. Polyethylene or polypropylene are preferably used to form layer 44.

A liner formed with the multi-layer wall 34 shown in FIG. 5 is preferably formed by known co-extrusion processes, but other known processes can also be used. For example, liner 16 is optionally formed from laminated sheet material heat sealed or plastics welded to form a bag-like shape, or liner 16 can be formed by known blow-molding processes.

The wall of the liner can optionally have any number of layers. For example, additional layers can be added for specific functions or simply to dispose of recycled plastics. The wall of the liner may be of any configuration so long as it provides a barrier against vapors, sufficient strength to withstand the manufacturing processes and continued use, and resistance against corrosion of the outer shell. Additionally, when the storage tank is integral with an electric or gas-fired water heater as described later with reference to FIGS. **6*a* and 6*b***, the liner must be capable of withstanding continuous elevated temperatures.

The storage tank embodiment described herein can be modified for a great number of uses and applications. For example, the storage tank can be a water storage tank for a water heating system. Specifically, the storage tank can be modified to accommodate the additional components required for operation and control of electric or gas-fired water heaters.

In the case of the lined electric water heater 46 illustrated in FIG. **6*a*, outer shell 50 and liner 48 are adapted to accommodate additional ports for a thermostat 56, a pressure relief valve 54, and for one or more heating elements 52. These additional ports are preferably located in the side wall of outer shell 50 as shown, but are optionally positioned in the top or bottom caps of the tank. The ports have the same structure as port 13 shown in FIG. 4**.

A lined gas-fired water heater 58 is shown in FIG. **6*b*. Lined gas-fired water heater 58, of course, has additional ports for a thermostat and a pressure relief valve and possibly others (not shown). More significantly, a shell component 60 and a liner component 62 of gas-fired water heater 58 accommodates a flue 64 running upwardly through the storage tank, preferably near the tank center. Bag-like liner 62 has an opening through and along its central axis, thereby providing liner 62 with a toroidal, or doughnut-like, shape. Flue 64 is optionally positioned near the wall of shell 60. It is apparent that liner 62** is easily modified to accommodate a flue having any position or shape.

The method of producing a storage tank according to this invention will now be described with reference to FIGS. 1–4. Liner 16 is formed as described with reference to FIGS. 3 and 5. A pre-assembly of outer shell 12 is formed by welding fittings 20 and 22 to top cap 18; forming cylindrical wall 24 by creating weld seam 28; and welding top cap 18 to cylindrical wall 24 along weld seam 30, thereby leaving the bottom of cylindrical wall 24 open.

Liner 16 is then inserted within the pre-assembly of the upper portion of outer shell 12 through the opening at the bottom of cylindrical wall 24. Fittings 36 and 38 on liner 16 are then mounted within fittings 20 and 22 on top cap 18 of outer shell 12 as shown in FIG. 4. Fittings 36 and 38 are retained securely within fittings 20 and 22, thereby securely positioning liner 16 within outer shell 12.

Bottom cap 26 is then welded to cylindrical wall 24 along weld seam 32, thereby enclosing outer shell 12 and capturing liner 16. As noted previously with reference to FIG. 3, the liner is optionally provided with a flexible wall or even circumferential pleats to permit the liner wall to collapse. Such a feature assists in the manufacturing process whereby vacuum applied to the liner is used to collapse and draw the liner upwardly so that the bottom cap can be welded to the cylindrical wall to complete the outer shell without damaging the liner. Details of a new method for forming a storage tank in this manner are disclosed in co-pending application Ser. No. 08/469,051.

Outer shell 12 with liner 16 is then mounted to base 14 shown in FIG. 1. Outer shell 12 is connected to base 14 via welding or mechanical fasteners at the manufacturer's option. Finally, inlet and outlet piping systems (not shown) are attached at inlet and outlet ports 13 and 15 (FIG. 1 ) so that water or other liquids can be introduced into and removed from storage tank 10.

Figure 6B:
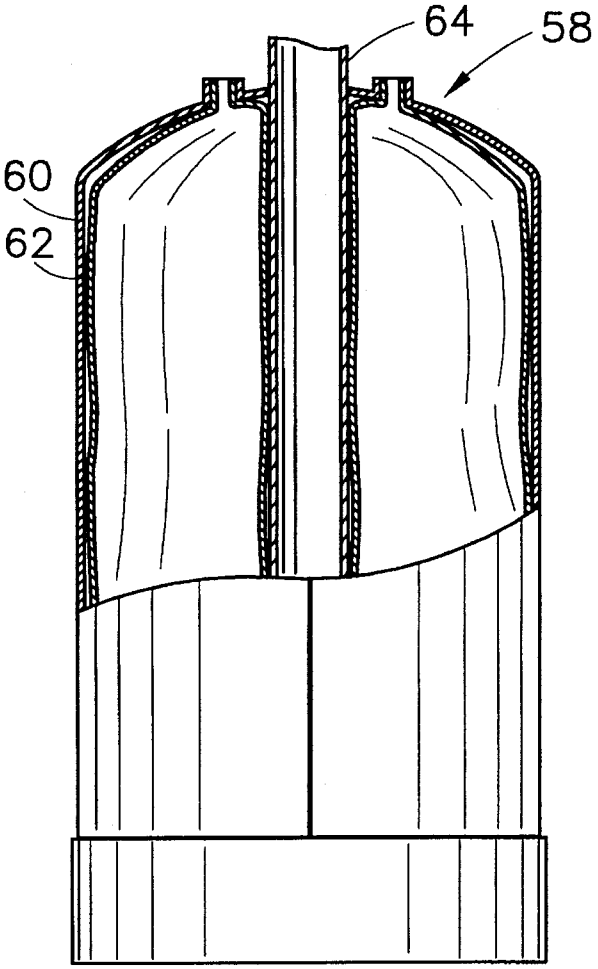
Figure 6A:
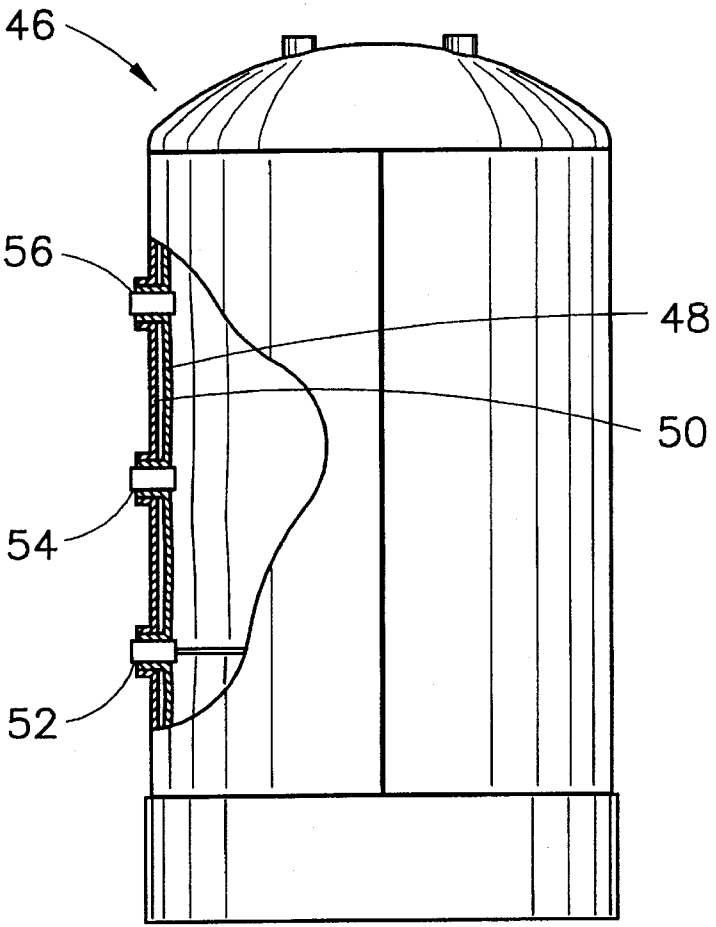

For water heaters 46 and 58 (FIGS. 6*a* and 6*b*), additional components are also installed. For example, heating element 52, pressure relief valve 54, and thermostat 56 are installed in ports in outer shell 50 to complete the electric water heater 46 shown in FIG. 6*a*.

In any embodiment a storage tank according to this invention provides significant benefits. It provides a reliable and inexpensive storage system that can be produced efficiently and rapidly, using automated production systems. The bag-like liner provides durable and reliable protection against corrosion of the outer shell, thereby providing a storage tank having a long service life. The bag-like liner also promotes even pressure distribution within the storage tank and, if provided with a heavy wall, permits the use of thinner material in the outer shell.

Although this invention has been described with reference to specific forms selected for illustration in the drawings, and with reference to many variations thereof, it will be appreciated that many other variations may be made without departing from the important feature of providing an inexpensive and reliable lined storage tank adaptable for use with electric or gas-fired water heaters. All variations to the embodiments explicitly described herein, including the substitution of equivalent elements for those specifically shown and described, are within the spirit and scope of the invention as defined in the appended claims.

What is claimed is:

1. An electric water heater comprising:

a lined water heater storage tank having a metallic shell with water inlet and outlet ports for the flow of water into and out from said storage tank, one or more heater ports, and a flexible liner positioned within said shell and substantially conforming to an inner surface of said shell for preventing contact between said water and said inner surface of said shell, said liner having ports corresponding to said water inlet and outlet ports on said metallic shell for the flow of water into and out from said liner and ports corresponding to said heater ports on said metallic shell, said ports on said liner being mounted at said ports on said metallic shell; and one or more electric heaters mounted at said one or more heater ports in said metallic shell, each said electric heater extending through one of said ports in said liner.

2. The lined storage tank described in claim 1, wherein said liner has a multi-layer wall, at least one of said layers forming a vapor barrier and at least one of said layers forming a corrosion barrier.

3. The lined storage tank described in claim 2, wherein said vapor barrier in said liner is a metallic layer.

4. The lined storage tank described in claim 2, wherein said corrosion barrier in said liner is a polymer selected from the group consisting of polyethylene and polypropylene.

5. An electric water heater comprising:

at least one electric heater;

a rigid shell having a plurality of water ports connected for flow of water between an interior region of said rigid shell and an exterior region of said rigid shell and one or more heater ports each receiving at least one said electric heater; and a flexible inner liner positioned within said interior region of said rigid shell and substantially conforming to an interior surface of said shell, said inner liner having a plurality of fittings mounted to a) said water ports in said rigid shell for the flow of water between an interior region of said inner liner and said exterior region of said rigid shell and b) said heater ports in said rigid shell, wherein said at least one electric heater extends through at least one of said fittings in said inner liner, said inner liner being sealed to prevent contact between said water in said interior region of said liner and said interior surface of said rigid shell.

6. The water heater described in claim 5, wherein said liner is a flexible bag having a multi-layered construction, including a vapor barrier layer sandwiched between at least two polymeric layers.

7. The water heater described in claim 5, wherein said rigid shell has a three-piece welded construction of two end caps separated by a cylindrical wall section.

* * * * *